US007809294B2

(12) United States Patent
Hattori et al.

(10) Patent No.: US 7,809,294 B2
(45) Date of Patent: Oct. 5, 2010

(54) IMAGE FORMING DEVICE CONTROLLING DRIVING OF A MOTOR BASED ON A DETECTED TEMPERATURE

(75) Inventors: Yoshiteru Hattori, Ichinomiya (JP); Atsushi Hayakawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 479 days.

(21) Appl. No.: 11/843,276

(22) Filed: Aug. 22, 2007

(65) Prior Publication Data

US 2008/0056742 A1 Mar. 6, 2008

(30) Foreign Application Priority Data

Aug. 30, 2006 (JP) ..... 2006-234179

(51) Int. Cl.
*G03G 15/00* (2006.01)

(52) U.S. Cl. ..... 399/44

(58) Field of Classification Search ..... 399/44, 399/38, 411

See application file for complete search history.

(56) References Cited

FOREIGN PATENT DOCUMENTS

JP 1-099495 4/1989
JP 3-265481 11/1991
JP 6-121592 4/1994
JP 2006208939 A * 8/2006

OTHER PUBLICATIONS

English Machine Translation of JP2006-208939.*

* cited by examiner

*Primary Examiner*—David M Gray
*Assistant Examiner*—Billy J Lactaoen
(74) *Attorney, Agent, or Firm*—Banner & Witcoff, Ltd.

(57) ABSTRACT

An image forming device includes an image forming arrangement including a medium passage and motor, and a temperature detecting unit. A supplying control unit allows supply of a recording medium in the medium passage responsive to an image-forming signal, and prevents supply of a recording medium in the passage responsive to a warm-up signal. A warm-up control unit controls the motor to drive, responsive to the warm-up signal, at a first speed if a detected temperature is least a first temperature, and a second speed lower than the first speed if the detected temperature detected is lower than the first temperature. An image forming control unit controls the motor to drive, responsive to the image-forming signal, at a third speed if the detected temperature is at least a second temperature, and a fourth speed lower than the third speed if the detected temperature is lower than the second temperature.

18 Claims, 8 Drawing Sheets

IMAGE FORMING DEVICE CONTROLLING DRIVING OF A MOTOR BASED ON A DETECTED TEMPERATURE

CROSS REFERENCE TO RELATED APPLICATION

This application claims priority from Japanese Patent Application No. 2006-234179 filed Aug. 30, 2006. The entire content of each of these priority applications is incorporated herein by reference.

BACKGROUND OF THE INVENTION

1. Field of the Invention

The present invention relates to an image forming device which has a motor capable of varying its driving load in accordance with temperature.

2. Description of the Related Art

In conventional various equipment having a motor for driving a load, such as an image forming device, the driving load increases due to thermal contraction of an object to be driven or increase in lubricant viscosity, in the case where such equipment is left at a low temperature.

In a device which is assumed to operate at a low temperature, therefore, a large motor enough to obtain a required torque, or a motor driven by a large current is used, so as to obtain the driving load required at the lowest temperature to ensure operation.

However, the torque, adjusted for the device to operate at a low temperature, is too high within a normal temperature range. This prevents the motor cost from being reduced, and the image forming device from being miniaturized.

In response to this, taking advantage of the relation that a motor torque becomes higher as an RPM (revolutions per minute) decreases as shown in FIG. 3, Japanese Unexamined Patent Application Publication No. 06-121592 proposes that a motor is driven at a low RPM so as to compensate for insufficient torque occurred at a low temperature in the case where an operating temperature of the motor is lower than the preset temperature.

However, in such a conventional device, where the operational speed of the motor varies simply with temperature, it is difficult for the device to form a steady image. One is because the device is not warmed up properly. Another is because the operational speed (RPM) of the motor changes at an inappropriate timing during image formation.

SUMMARY OF THE INVENTION

In view of the above-described drawbacks, it is an objective of the present invention to provide an image forming device capable of varying the operational speed (RPM) of a motor in accordance with temperature at an appropriate timing, for steady image formation and efficient operation.

In order to attain the above and other objects, the present invention provides an image forming device including a casing, an image forming arrangement, a supplying control unit, a temperature detecting unit, a warm-up control unit, and an image forming control unit. The image forming arrangement is provided in the casing and includes a medium passage and a motor configured to drive in response to an image-forming signal or a warm-up signal. The supplying control unit allows a recording medium to be supplied in the medium passage in response to the image-forming signal, and prevents a recording medium from being supplied in the medium passage in response to the warm-up signal. The temperature detecting unit detects a temperature inside or around the casing. The warm-up control unit controls the motor to drive at a first speed in response to the warm-up signal if a temperature detected by the temperature detecting unit is equal to or higher than a first temperature, and to drive at a second speed lower than the first speed in response to the warm-up signal if a temperature detected by the temperature detecting unit is lower than the first temperature. The image forming control unit controls the motor to drive at a third speed in response to the image-forming signal if a temperature detected by the temperature detecting unit is equal to or higher than a second temperature, and to drive the motor at a fourth speed lower than the third speed in response to the image-forming signal if a temperature detected by the temperature detecting unit is lower than the second temperature. The first speed is equal to or different from the third speed. The second speed is equal to or different from the fourth speed. The first temperature is equal to or different from the second temperature.

Another aspect of the present invention provides an image forming including a casing, an image forming arrangement, a supplying control unit, a temperature detecting unit, and a warm-up control unit. The image forming arrangement is provided in the casing and includes a medium passage and a motor configured to drive in response to an image-forming signal or a warm-up signal. The supplying control unit allows a recording medium to be supplied in the medium passage in response to the image-forming signal, and prevents a recording medium from being supplied in the medium passage in response to the warm-up signal. The temperature detecting unit detects a temperature inside or around the casing. The warm-up control unit controls the motor to drive at a first speed in response to the warm-up signal if a temperature detected by the temperature detecting unit is equal to or higher than a first temperature, and to drive at a second speed lower than the first speed until a temperature detected by the temperature detecting unit has reached a second temperature equal to or higher than the first temperature in response to the warm-up signal if a temperature detected by the temperature detecting unit is lower than the first temperature.

Another aspect of the present invention provides an image forming device including a casing, an image forming arrangement, a supplying control unit, a temperature detecting unit, a warm-up control unit, and an image forming control unit. The image forming arrangement is provided in the casing and includes a medium passage and a motor configured to drive in response to an image-forming signal or a warm-up signal. The supplying control unit allows a recording medium to be supplied in the medium passage in response to the image-forming signal, and prevents a recording medium from being supplied in the medium passage in response to the warm-up signal. The temperature detecting unit detects a temperature inside or around the casing. The warm-up control unit controls the motor to drive at a first speed until a temperature detected by the temperature detecting unit has reached a second temperature in response to the warm-up signal if a temperature detected by the temperature detecting unit is lower than a first temperature lower than the second temperature. The image forming control unit controls the motor to drive at a second speed higher than the first speed in response to the image-forming signal after the warm-up control unit controls the motor to drive at a first speed until a temperature detected by the temperature detecting unit has reached a second temperature.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

The terms "upward", "downward", "upper", "lower", "above", "below", "beneath" and the like will be used throughout the description assuming that the ink jet printer is disposed in an orientation in which it is intended to be used.

Hereinafter, embodiments will be described with reference to the accompanying drawings.

First Embodiment

Figure 1:
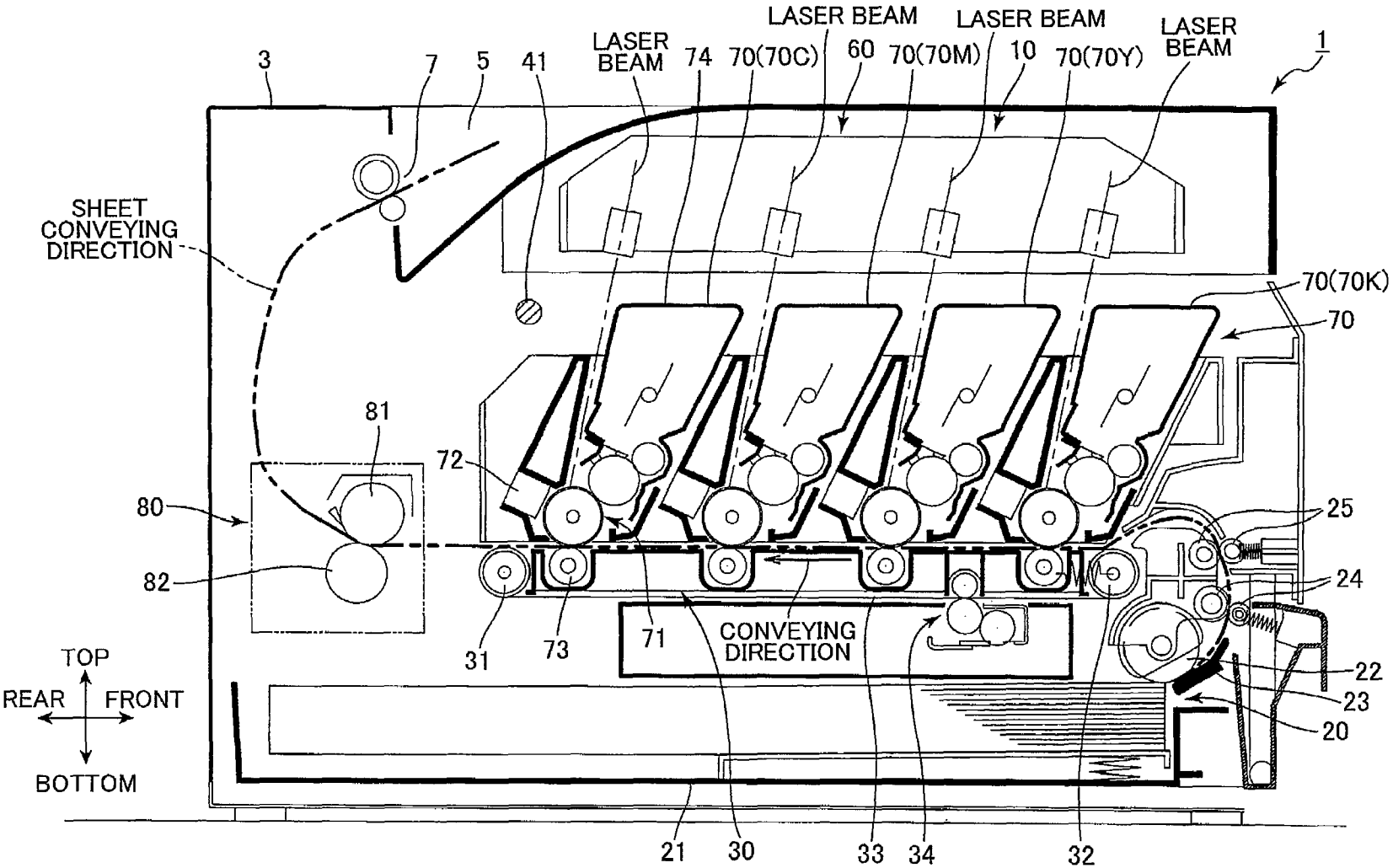
FIG. 1 is a side sectional view schematically showing the structure of a laser printer according to the present invention.

FIG. 1 is a side sectional view schematically showing the structure of a laser printer 1 as an image forming device according to a first embodiment. In the following description, the right side of FIG. 1 is defined as the front side.

<Overall Structure of Laser Printer>

The laser printer 1, which is a direct transfer tandem-type color laser printer, includes a substantially box-like main body case 3 as shown in FIG. 1. On the top surface of the main body case 3, a discharge tray 5 on which sheets on which image formation has been formed is placed.

The main body case 3 covers a feeder unit 20 which feeds a sheet on which an image is formed; a feed system 30 which further feeds the sheet fed by the feeder unit 20; an image forming unit 10 which forms an image on the sheet fed by the feed system 30; and a control unit 40 (see FIG. 2) which drives and controls these components. Hereinafter, the feeder unit 20, the feed system 30, and the image forming unit 10 are collectively referred to as an "image forming system".

<Feeder Unit>

The feeder unit 20 includes the following components: a feed tray 21 attached to a lowermost portion of the main body case 3 so as to be pulled out forward, on which a sheet on which an image is formed is placed; a pickup roller 22 disposed above the front end of the feed tray 21 so as to take the sheet out of the feed tray 21; a separation pad 23 which applies conveyance resistance to the sheet taken by the pickup roller 22 out of the feed tray 21 so as to separate one sheet from another; and feed rollers 24 and 25 which feed the sheet sent from between the pickup roller 22 and the separation pad 23, to the feed system 30.

<Feed System>

The feed system 30 includes the following components: a drive roller 31 which rotates in synchronization with the operation of the image forming unit 10; a follower roller 32 rotatably provided at a position far from the drive roller 31; and a conveying belt 33 extended between the drive roller 31 and the follower roller 32. Driven by the drive roller 31, the conveying belt 33 circulates in the counterclockwise direction in FIG. 1 to convey the sheet mounted on its top surface rearward.

A belt cleaner 34 for removing toner, paper powder and the like adhered to the conveying belt 33 is provided under the feed system 30.

<Image Forming Unit>

The image forming unit 10 includes the following components: a scanner unit 60 which forms a latent image on the surface of a photoconductive drum 71 (to be described later); a process unit 70 which develops the latent image formed by the scanner unit 60 with toner, and transfers the developed image to the sheet fed by the feed system 30; and a fixing unit 80 which fixes the image transferred on the sheet by the process unit 70.

The process unit 70 includes four process cartridges 70K, 70Y, 70M, and 70C which perform development with toner corresponding to colors of black, yellow, magenta and, cyan, arranged from the upstream side, in the conveying direction of the conveying belt 33. As is generally known, the process cartridges 70K, 70Y, 70M, and 70C have the same structure, including a photoconductive drum 71, a charger 72, a transfer roller 73, and a developer cartridge 74.

The scanner unit 60 includes a laser generator, a polygon mirror, a lens, and a reflecting mirror. The scanner unit 60 applies laser beams L of each color based on predetermined image data, to the surface of the photoconductive drum 71 of the corresponding process cartridge at high speed so that a latent image is formed on the surface of the photoconductive drum 71.

The fixing unit 80 includes a heat roller 81 provided on the side of the printing surface of a sheet, which feeds a sheet while heating the toner transferred to the sheet; and a pressure roller 82 provided on the opposite side of the heat roller 81 across the sheet, which presses the sheet onto the heat roller 81. The fixing unit 80 fixes the toner on the sheet by heat for fixation. The sheet which has passed through the fixing unit 80 is discharged to the discharge tray 5 through the discharge slit 7.

<Control Unit>

Figure 2:
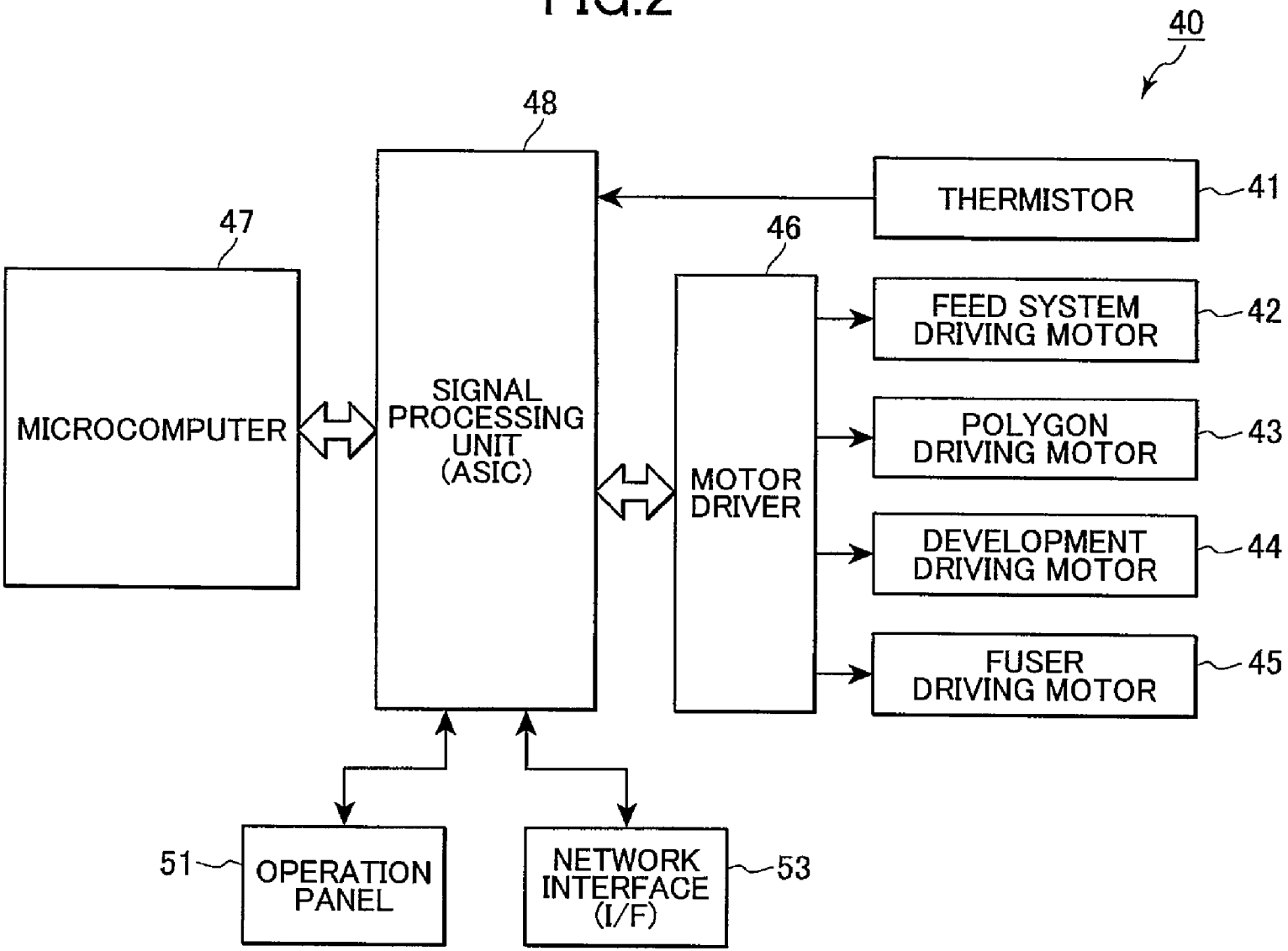
FIG. 2 is a block diagram schematically showing the structure of a control unit.

FIG. 2 is a block diagram showing the structure of part of the control unit 40, relevant to the present embodiment.

As shown in FIG. 2, the control unit 40, provided in a space between the scanner unit 60 and the process unit 70, includes a thermistor 41 (see FIG. 1) which detects the temperature inside the main body case 3 (hereinafter referred to as an "in-device temperature"). The control unit 40 further includes a feed system driving motor 42 which drives the various rollers of the feeder unit 20 as well as the drive roller 31 of the feed system 30; a polygon driving motor 43 which drives the polygon mirror of the scanner unit 60; a development driving motor 44 which drives the photoconductive drums 71 of the process cartridges 70K, 70Y, 70M, and 70C; a fix driving motor 45 which drives the heat roller 81 of the fixing unit 80;

and a motor driver 46 which provides drives these motors with driving power. The control unit 40 still further includes a well-known microcomputer 47 which has a CPU, a ROM, and a RAM as its main components; and a signal processing unit 48 which processes signals from various sensors and units of the device including the thermistor 41 so as to transmit the signals to the microcomputer 47, having an ASIC for generating various signals under the direction of the microcomputer 47 to transmit the signals to the motor driver 46 and other units.

The signal processing unit 48 controls input to/output from at least the following components in addition to the thermistor 41 and the motor driver 46: an operation panel 51 formed of a liquid crystal display panel which includes a cursor key and a switch for entering various settings and directions, and a menu screen for displaying various menu items, so as to display contents entered by a user and various notices to be given to a user; and a network interface (I/F) 53 which accepting a print job request via a communication network such as LAN from an external device (for example, a personal computer).

Figure 3:
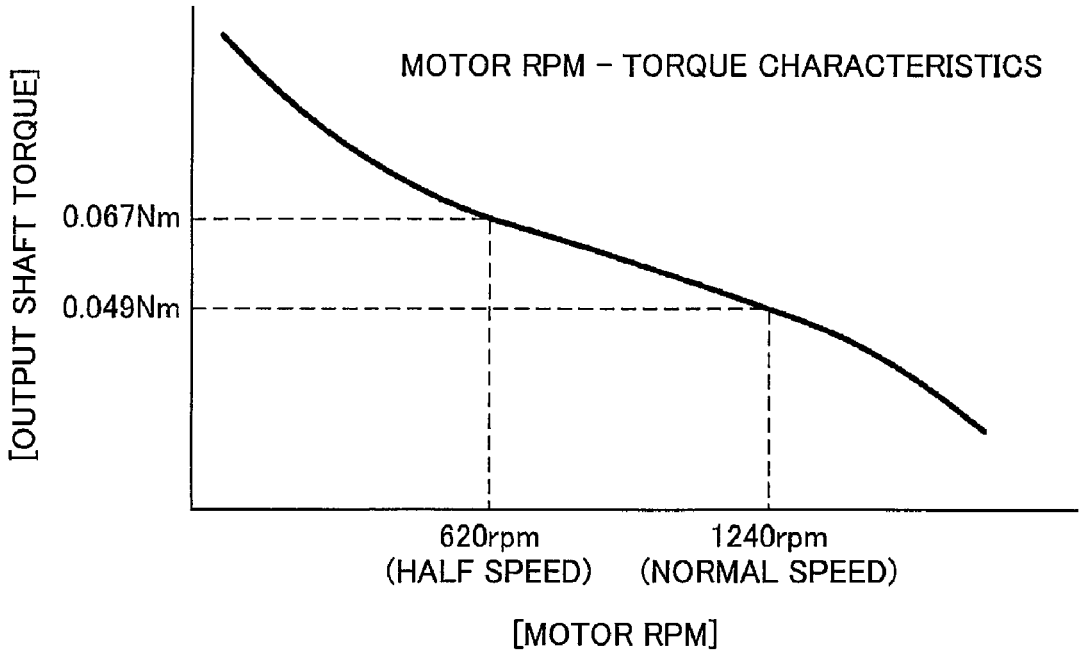
FIG. 3 illustrates characteristics of a motor.

As each of the motors 42 to 45 which drives the image forming system, as shown in FIG. 3, a stepping motor is employed, in which the torque of its output shaft decreases as the motor operational speed (RPM) increases.

Hereinafter, the definition "normal speed" means an rpm at which a torque large enough to drive the load of the motor is obtained within its specified operation guarantee temperature range (10° C. to 32.5° C. in this embodiment, see FIG. 6) (1240 rpm in this embodiment). The definition "half speed" means an rpm half of the normal speed (620 rpm in this embodiment).

<Operation Control>

Hereinafter, referring to the flowcharts shown as FIGS. 4 and 5, a description is given for a main process to be performed by the microcomputer.

After the laser printer 1 is power-on, and then, each unit of the device is initialized, the main process is performed.

Figure 4:
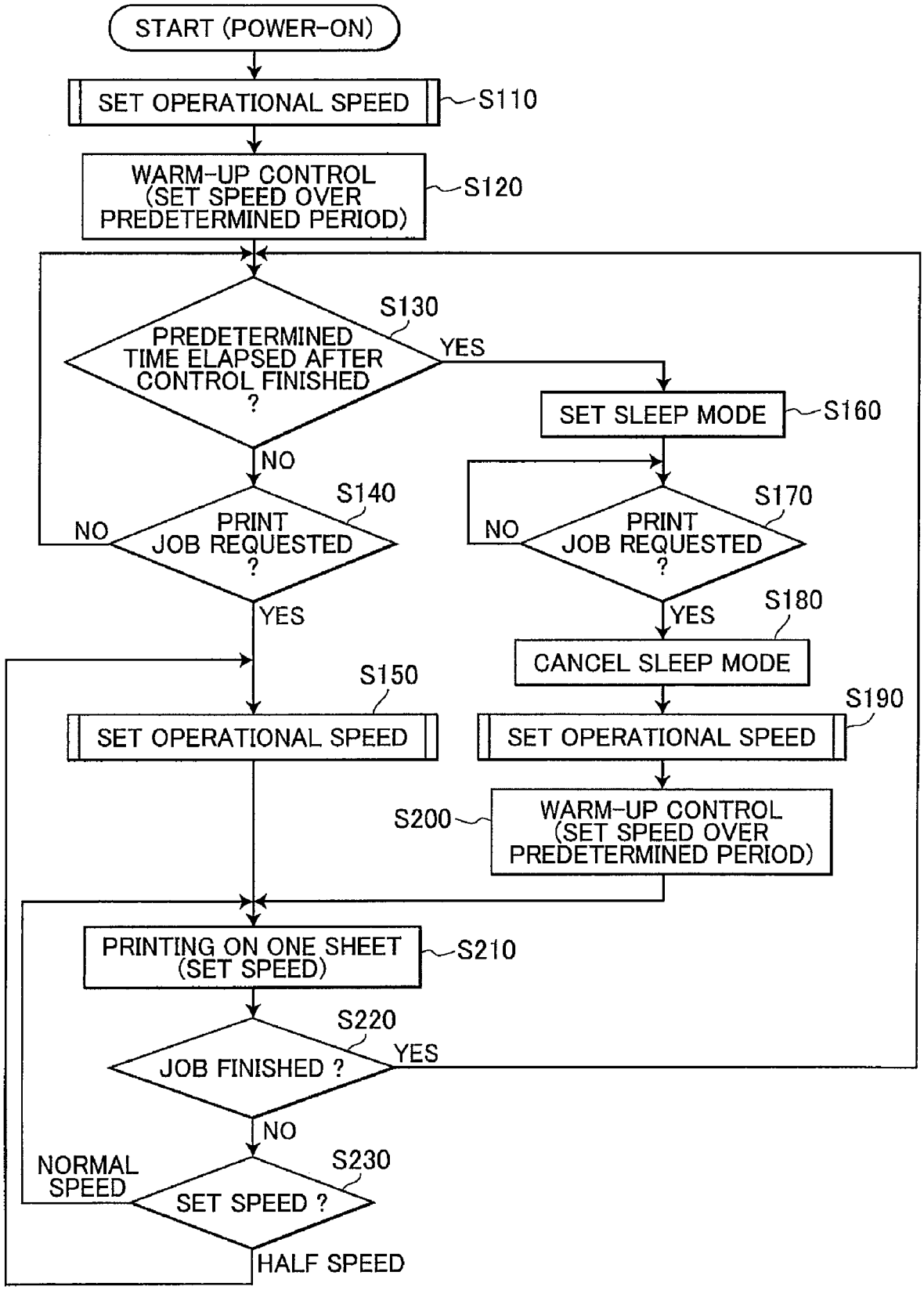
FIG. 4 is a flowchart showing a main process according to a first embodiment.

As shown in FIG. 4, the main process starts with S110 for setting the operational speed of the motor.

Figure 5:
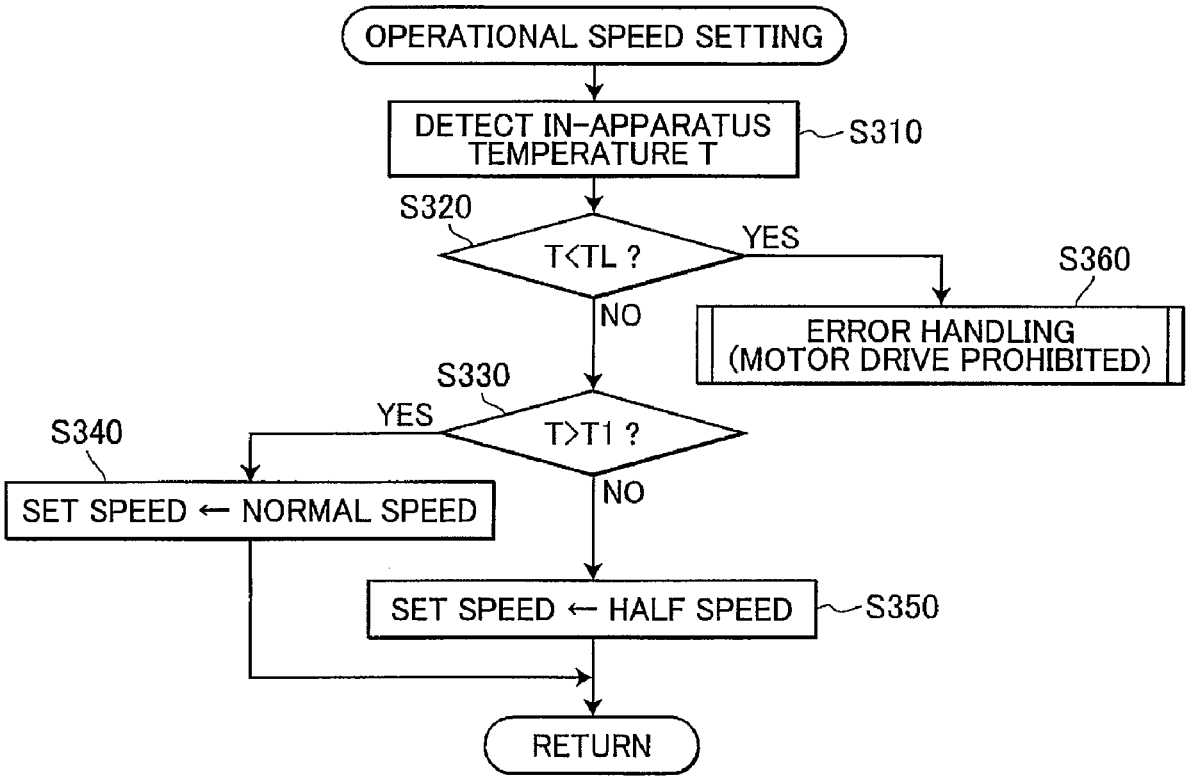
FIG. 5 is a flowchart showing details of an operational speed setting.

As shown in FIG. 5, in order to set the operational speed, the thermistor 41 detects an in-device temperature T in S310. Next, it is determined in S320 whether or not the in-device temperature T is lower than a temperature TL that is the lowest within a preset operating range. If the in-device temperature T is lower than the temperature TL (S320: YES), an error process for prohibiting the motor from driving is set in S360. Thus, the device is prevented from being damaged due to forced operation.

In the error process, specifically, a notice is sent via the operation panel 51, saying that the motor is prohibited from driving. After that, a standby state is maintained until a power-off or reset command is given via the operation panel 51.

On the other hand, if it is determined that the in-device temperature T is higher than the temperature TL (S320: NO), it is determined in S330 whether or not the in-device temperature T is higher than a first temperature T1. The first temperature T1 has to be set so that the drive capability obtained when the motor is driven at normal speed is sufficiently larger than the driving load at the first temperature T1.

If it is determined that the in-device temperature T is higher than the first temperature T1 (S330: YES), the operational speed of the motor is set to normal speed in S340. On the other hand, if it is determined that the in-device temperature T is equal to or lower than the first temperature T (S330: NO), the operational speed of the motor is set to half speed in S350. The operational speed setting is then finished.

Figure 6:
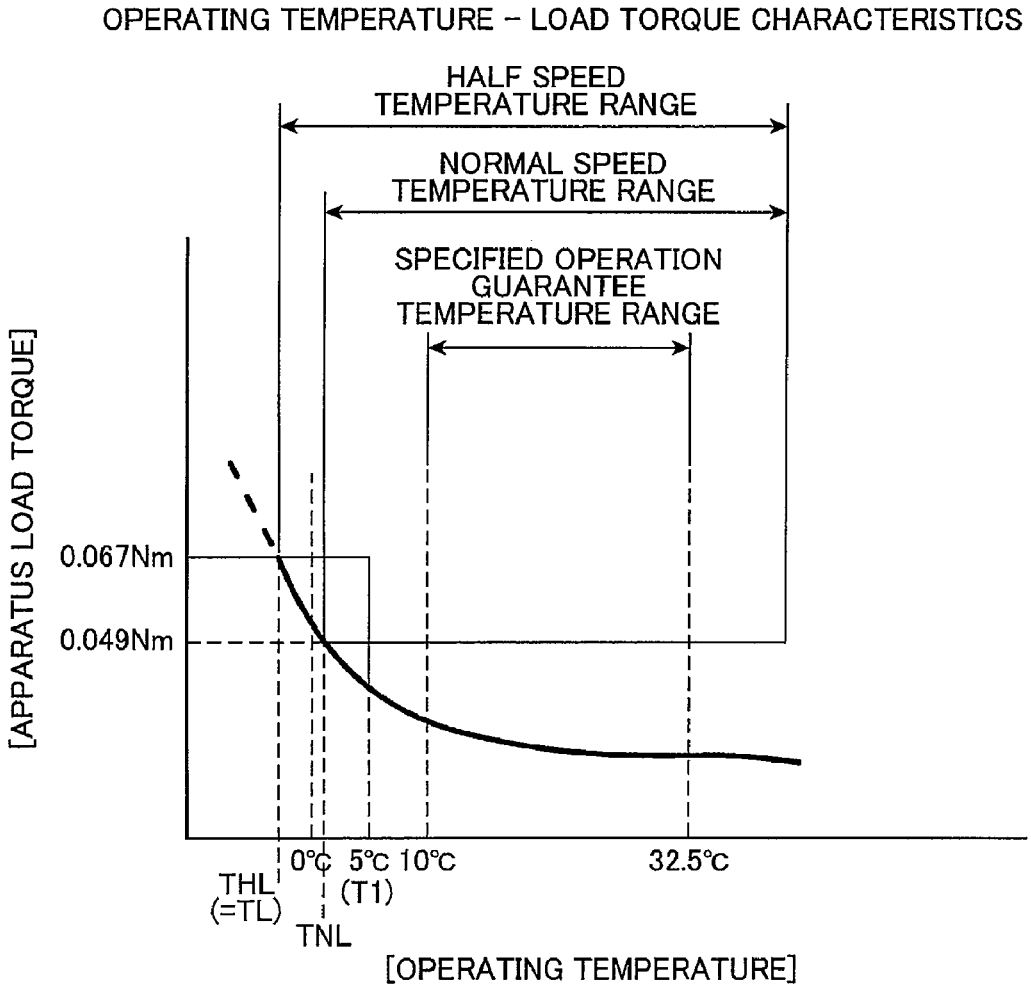
FIG. 6 illustrates the relation between the motor characteristics and a lowest temperature/a first temperature/second temperature.

As shown in FIG. 6, the temperature TL is set to a value equal to or larger than a temperature THL (−2° C. in this embodiment) that is the lowest within temperatures at which the torque of the motor set to the half speed can drive the load. Also, the first temperature T1 is set to a value equal to or larger than a temperature TNL (5° C. in this embodiment) that is the lowest within temperatures at which the torque of the motor set to the normal speed can drive the load.

Return to FIG. 4, after the operational speed setting (S110) is finished, a warm-up control is performed at a speed set in S110 over a predetermined period of time in S120.

The "warm-up control" is defined as "to operate all the available motors without forming an image on a sheet". Specifically, this operation is performed so that the driving force of the feed system driving motor 42 is not transferred to the pickup roller 22 of the feeder unit 20. The warming-up control is performed when power is turned on, or when the laser printer 1 returns to normal operating state from sleep mode in the present embodiment. The laser printer 1 is provided with a sensor (not shown) for detecting a recording medium fed in a feeding path. The microcomputer 47 controls the image forming unit 10 to form an image on the recording medium, only when the sensor detects the recording medium.

In the "warm-up control" according to the present embodiment, following operations are performed: the heat roller 81 is heated to reach a predetermined temperature; the conveying belt 33, the belt cleaner 34, and the photoconductive drum 71 are driven to remove toner adhered to the conveying belt 33 and the photoconductive drum 71; toner accommodated in a toner accommodating chamber (not shown) is agitated; remaining amount of toner agitated is detected; a timing when an image should be formed is checked while driving the polygon motor. However, the pickup roller 22 is not driven in the "warm-up control". Thus, the motors are driven without forming an image on the recording medium.

The "predetermined period of time" when the operational speed is set to the half speed is longer than the "predetermined period of time" when the operational speed is set to the normal speed. Specifically, the "period of time" for half speed is longer than a value considerably larger than the "period of time", that is obtained by a experiment, taken for increasing the in-device temperature T from the temperature T1 to a second temperature T2 equal to or higher than the first temperature T1 by warming up.

Figure 7:
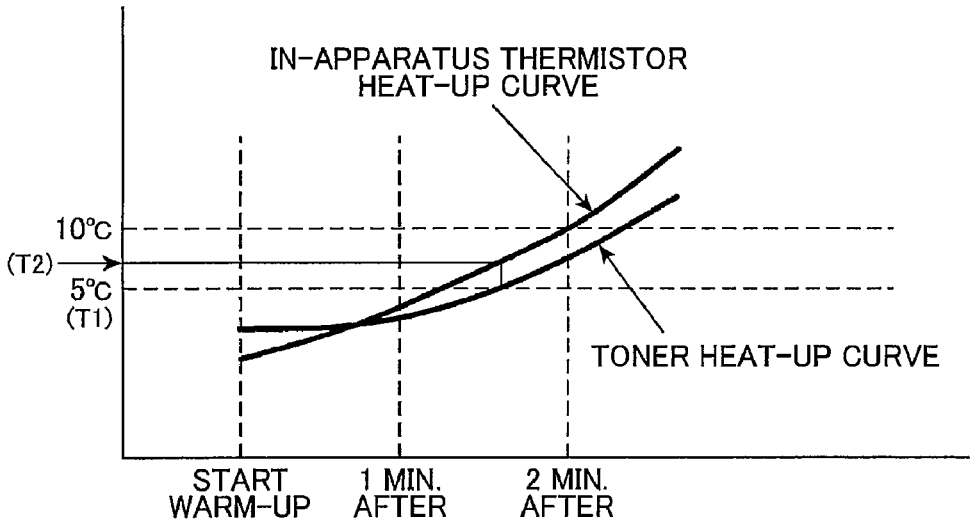
FIG. 7 is a graph showing an in-device temperature and a heat-up characteristic of an object to be warmed up.

As shown in FIG. 7, the heat-up curve of the in-device temperature to be sensed by the thermistor 41 does not necessarily agree with the heat-up curve of an object (for example, toner) to be heated by warm-up control. In consideration of the difference, the second temperature T2, specifically, the period of time for half speed, have to be set so that the object is, without failure, heated up to a temperature higher than a desired temperature.

On the other hand, the "period of time" for normal speed does not have to be set in consideration of the in-device temperature T, since the in-device temperature T is higher than the first temperature T1. Only in consideration of the time required for operation-checking each unit, a minimum length of time may be set therefor.

After the warm-up control is finished, it is determined in S130 whether or not a preset period of time has elapsed after either the last control of warm-up control in S120 or print control in S210 (to be described later) is finished.

If the period of time has not elapsed yet (S130: NO), it is determined in S140 whether or not a print job has been requested via a network I/F 53 or the like. If no print job has been requested (S140: NO), the process returns to S130 so that S130 and S140 are repeated.

If any print job has been requested (S140: YES), the same operational speed setting as in S110 is performed in S150 to reset the operational speed of the motor. The process then proceeds to S210.

On the other hand, if it is determined that a predetermined time has elapsed (S130: YES), a sleep mode in which power supply is stopped except for units required for accepting a print job is set in S160. Subsequently, it is determined in S170 whether a print job has been requested. If a print job has been requested (S170: YES), the sleep mode is cancelled in S180. Specifically, power supply to each unit is started so that print control becomes available.

Then, in S190, the same operational speed setting as in S110 is performed to reset the operational speed of the motor. Subsequently, in S200, in the same way as in S120, a warm-up control for driving the motor over a predetermined period of time at the speed reset in S190 is performed. The process then proceeds to S210.

In S210, the motor is driven at the speed reset in the operational speed setting performed in S150 or S190 to perform a print control for printing on one sheet according to the print job accepted in S140 or S170.

Subsequently, it is determined in S220 whether or not all the printing requested by the accepted print job has been completed by printing of one sheet. If not (S220: NO), it is determined in S230 that the present speed is set to which of the normal speed or the half speed.

If the present speed has been set to half in S230, the process returns to S150, and an operational speed setting for resetting the operational speed of the motor is performed. A print control is then performed at the reset speed.

On the other hand, if the present speed has been set to normal in S230, the process returns to S210, and a print control is performed immediately without resetting the operational speed.

If it is determined that all the printing requested by the accepted print job has been completed (S220: YES), the process returns to S130, and a standby state is maintained until a next print job is requested.

<Effect>

As described above, in the laser printer according to the present embodiment, if the in-device temperature T at the time of the startup of warm-up control or print control is lower than first temperature T1, the motor is driven at half speed. Therefore, the motor torque, which has become relatively insufficient due to an increasing driving load caused by a low temperature, is compensated for, without employing a larger motor or a larger driving current.

Also in the laser printer 1, when power is turned on or sleep mode is cancelled, a warm-up control is performed at the operational speed set according to the in-device temperature T over a predetermined period of time. If the temperature does not rise sufficiently (does not reach the first temperature T1), the motor is driven at half speed even for print control. Therefore, printing is started quickly without prolonging warm-up operation than required.

Furthermore, when the operational speed is set to the half speed, the in-device temperature T is repeatedly detected every time a print control for one sheet is finished, thereby resetting the speed. Therefore, when the in-device temperature T becomes higher enough to drive the motor at the normal speed, the operational speed of the motor is set to the normal speed. Thus, the time required for printing becomes shorter without prolonging printing at the half speed than required.

Furthermore, the operational speed of the motor is maintained to a fixed value during a period for printing one sheet. Therefore, a steady image is formed successfully without causing uneven printing in one sheet due to speed change.

Also in the laser printer 1, if the in-device temperature T is lower than the temperature TL, or equivalently, if the torque does not become sufficient for the driving load even when the motor is driven at half speed, the motor is prohibited from driving. Therefore, the damage caused by driving the motor under excessive load is prevented.

In the present embodiment, the thermistor 41 is provided inside the main body case 3 so as to detect the in-device temperature T. However, the structure may be such that the thermistor 41 detects the temperature outside the main body case 3, or equivalently, the ambient temperature of the laser printer 1.

The ambient temperature does not change drastically due to warm-up control and print control by the laser printer 1 under ordinary circumstances. Therefore, in the case where the ambient temperature is detected, the ambient temperature may be detected less frequently as well as speed resetting.

In the present embodiment, in-device temperature T detection and speed resetting are repeated every time a print control for one sheet is finished, if the speed is set to half speed. If a plurality jobs are requested, the detection of the in-device temperature T and resetting the operational speed of the motor may be repeated every time one job is finished.

Second Embodiment

Next, a description is given for a second embodiment.

In this embodiment, a main process to be performed by the microcomputer 47 is partially different from the main process of the first embodiment. Therefore, a description is given mainly for the difference.

Figure 8:
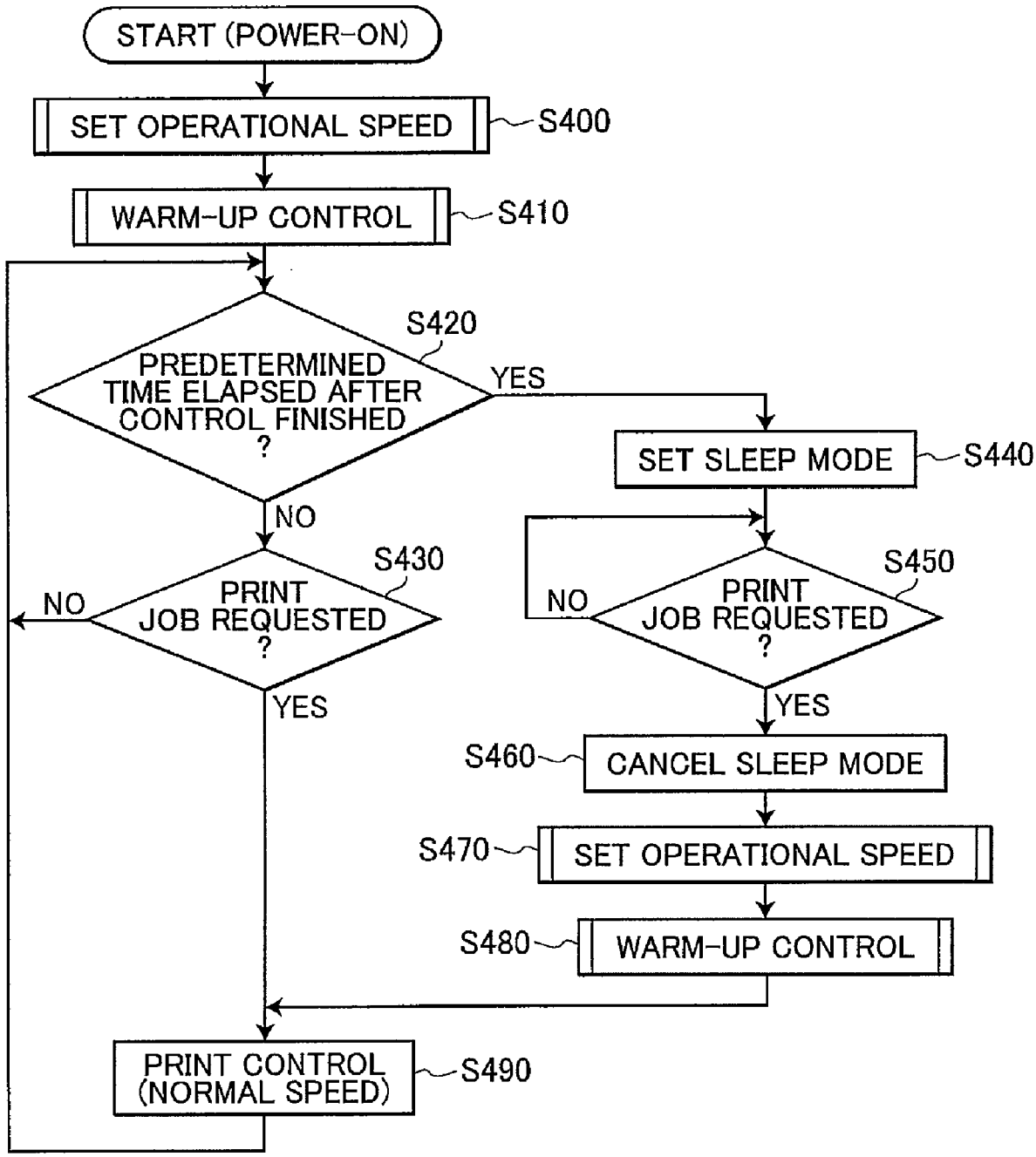
FIG. 8 is a flowchart showing a main process according to a second embodiment.

As shown in FIG. 8, the main process starts with S400 for setting the operational speed of the motor. Note that the operational speed setting is the same as in S110 according to the first embodiment.

Figure 9:
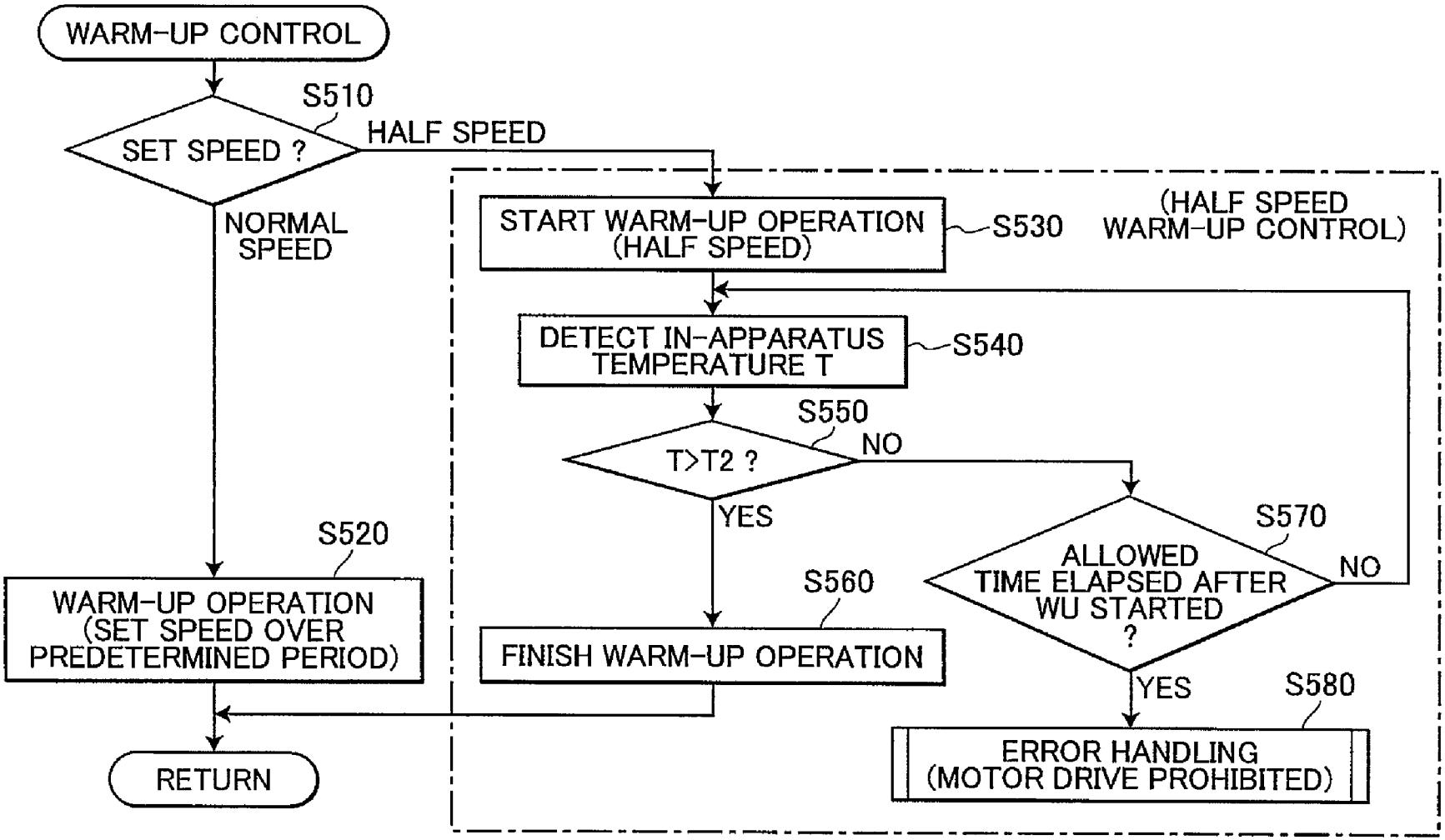
FIG. 9 is a flowchart showing details of a warm-up control and a half speed warm-up control.

Subsequently, a warm-up control is performed in S410. As shown in FIG. 9, for the warm-up control, firstly, it is determined in S510 whether the operational speed set in S410 is normal or half. If the operational speed is normal, the motor is driven at normal speed only over a predetermined period of time for warming up in S520. The warm-up control is then finished.

On the other hand, if the operational speed is half, the motor starts to be driven at half speed for warming up in S530. Subsequently, in S540, the thermistor 41 detects the in-device temperature T.

Then, it is determined in S550 whether or not the detected in-device temperature T is higher than the second temperature T2 (set to be equal to or higher than the first temperature T1). If equal to or lower than the second temperature T2 (S550: NO), it is determined in S570 whether or not an allowed time has elapsed after starting the warm-up control in S530.

The first temperature T1 and the second temperature T2 are set in the same way as in the first embodiment. The allowed time is set, for example, to a value approximately twice to three times as large as an average of time that the in-device temperature T takes to reach the second temperature T2 from the lowest temperature TL (3 minutes in this embodiment) when the motor is driven at half speed for warming up.

If it determined that the allowed time has not elapsed (S570: NO), the process returns to S540 so as to repeat the above procedure. On the other hand, it is determined that the allowed time has elapsed (S570: YES), an error process is set to prohibit the motor from driving in S580. The error process is the same as in S360 of the first embodiment.

If it is determined that the in-device temperature T is higher than the second temperature T2 (S550: YES), the warm-up control is finished in S560.

As described above, if the operational speed is set to normal, that is, the in-device temperature T has already been equal to or higher than the first temperature T1, the warm-up control is performed at normal speed only over a predetermined period of time. On the other hand, if the operational speed is set to half, the warm-up control is performed at half speed until the in-device temperature T becomes higher than the second temperature T2. Thus, the object to be warmed up is heated up to a value equal to or higher than the first temperature T1 without failure. However, if the in-device temperature T does not reach the second temperature T2 even though the allowed time has elapsed, the motor is prohibited from driving.

Return to FIG. 8, after the warm-up control (S410) is finished, it is determined in S420 whether or not a preset period of time has elapsed after either the last control of warm-up control in S410 or print control in S490 (to be described later) is finished If the period of time has not elapsed yet (S420: NO), it is determined in S430 whether or not a print job has been requested via the network I/F 53 or the like. If no print job has been requested (S430: NO), the process returns to S420 so that S420 and S430 are repeated. If any print job has been requested (S430: YES), the process proceeds to S490.

On the other hand, if it is determined that a predetermined time has elapsed (S420: YES), a sleep mode in which power supply is stopped except for units required for accepting a print job is set in S440. Subsequently, it is determined in S450 whether a print job has been requested. If a print job has been requested (S450: YES), the sleep mode is cancelled in S460. Specifically, power supply to each unit is started so that print control becomes available.

Then, in S470, the same operational speed setting as in S400 is performed to reset the operational speed of the motor. Subsequently, in S480, in the same way as in S410, a warm-up control is performed. The process then proceeds to S490.

In S490, the motor is driven at normal speed to perform all the requested print controls according to the print job accepted in S430 or S450. The process then returns to S420, and a standby state is maintained until a next print job is requested.

<Effect>

As described above, in this embodiment, if the in-device temperature T at the time of power-on or sleep mode cancellation is lower than first temperature T1, the motor is driven at half speed. Similarly to the first embodiment, the motor torque, which has become relatively insufficient due to an increasing driving load caused by a low temperature, is compensated for, without employing a larger motor or a larger driving current.

Also in the laser printer 1 according to this embodiment, a warm-up control is continued at half speed until the in-device temperature T becomes equal to the second temperature T2. In performing a print control, therefore, the load to be driven by the motor is reduced sufficiently to a value light enough to be driven by the torque obtained at normal speed without any difficulty.

In the laser printer 1 according to this embodiment, the motor is stopped from driving if the warm-up control at half speed is not finished even when the allowed time has elapsed. When the in-device temperature does not reach the value of the second temperature T2 even if any number of warm-up controls is performed, a warm-up control is prevented from being prolonged wastefully.

Third Embodiment

Next, a description is given for a third embodiment.

In the present embodiment, a main process to be performed by the microcomputer 47 is partially different from the main process of the above embodiments. Therefore, a description is given mainly for the difference.

Figure 10:
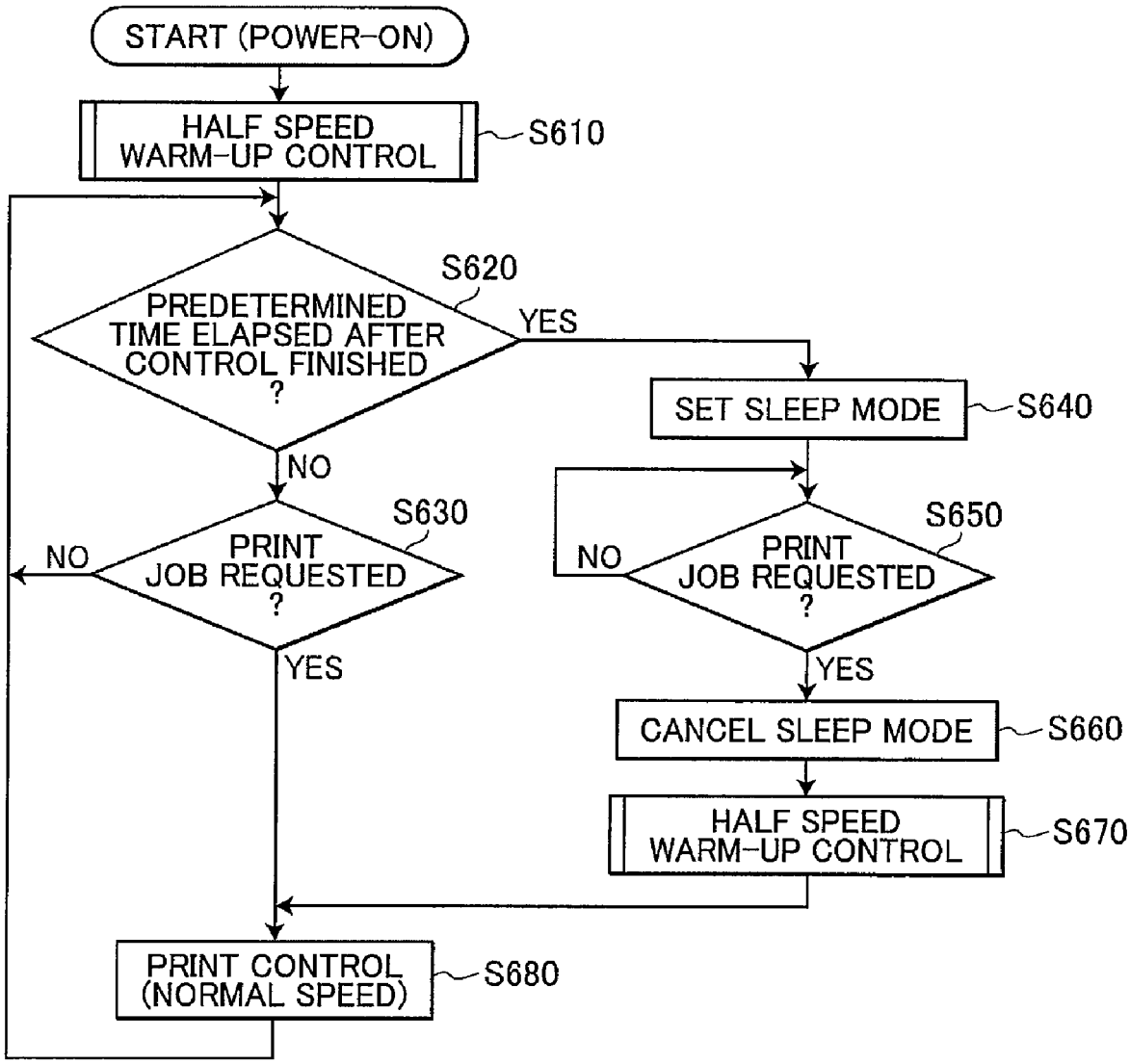
FIG. 10 is a flowchart showing a main process according to a third embodiment.

As shown in FIG. 10, the main process starts with S610. In the S610, a warm-up control is continued at half speed until the in-device temperature T becomes higher than the second temperature T2. In this half speed warm-up control, specifically, the procedure from S530 to S580 defined by alternate long and short dash lines is to be performed.

Subsequently, it is determined in S620 whether or not a preset period of time has elapsed after either the last control of warm-up control in S610 or print control in S680 (to be described later) is finished.

If the period of time has not elapsed yet (S620: NO), it is determined in S630 whether or not a print job has been requested via the network I/F 53 or the like. If no print job has been requested (S630: NO), the process returns to S620 so that S620 and S630 are repeated. If any print job has been requested (S630: YES), the process proceeds to S680.

On the other hand, if it is determined that a predetermined time has elapsed (S620: YES), a sleep mode in which power supply is stopped except for units required for accepting a print job is set in S640. Subsequently, it is determined in S650 whether a print job has been requested.

If a print job has been requested (S650: YES), the sleep mode is cancelled in S660. Specifically, power supply to each unit is started so that print control becomes available. Subsequently, in S670, the same half speed warm-up control is performed as in S610. The process then proceeds to S680.

In S680, the motor is driven at normal speed to perform all the requested print controls according to the print job accepted in S430 or S450. The process then returns to S620, where a standby state is maintained until a next print job is requested.

<Effect>

As described above, according to the laser printer 1 of this embodiment, a warm-up control is continued consistently at half speed until the in-device temperature T becomes equal to the second temperature T2. In performing a print control, therefore, the load to be driven by the motor is reduced sufficiently to a value light enough to be driven by the torque obtained at normal speed without any difficulty.

According to the laser printer 1 of this embodiment, a warm-up control is performed consistently at half speed, thereby simplifying the control procedure.

Although the present invention has been described with respect to specific embodiments, it will be appreciated by one skilled in the art that a variety of changes may be made without departing from the scope of the invention.

In above-described embodiments, the feeder unit, the feed system, and the image forming unit are collectively referred to as the image forming system. However, the image forming system may include another unit that operates in the image forming operation.

Further, in the above-described embodiments, the laser printer is used as the image forming device. However, the image forming device only have to include a motor for operate at least one of the feed unit, the feed system, and the image forming unit.

What is claimed is:

1. An image forming device comprising:

a casing;

an image forming arrangement provided in the casing and including a medium passage and a motor configured to drive in response to an image-forming signal or a warm-up signal;

a supplying control unit configured to allow a recording medium to be supplied in the medium passage in response to the image-forming signal, and prevent a recording medium from being supplied in the medium passage in response to the warm-up signal;

a temperature detecting unit configured to detect a temperature inside or around the casing;

a warm-up control unit configured to control the motor to drive at a first speed in response to the warm-up signal if a temperature detected by the temperature detecting unit is equal to or higher than a first temperature, and to drive at a second speed lower than the first speed in response to the warm-up signal if a temperature detected by the temperature detecting unit is lower than the first temperature; and an image forming control unit configured to control the motor to drive at a third speed in response to the image-forming signal if a temperature detected by the temperature detecting unit is equal to or higher than a second temperature, and to drive the motor at a fourth speed lower than the third speed in response to the image-forming signal if a temperature detected by the temperature detecting unit is lower than the second temperature, the first speed being equal to or different from the third speed, the second speed being equal to or different from the fourth speed, and the first temperature being equal to or different from the second temperature, wherein a temperature of the toner changes based on a first heat-up characteristic and a temperature inside or around the casing changes based on a second heat-up characteristic, the second temperature is set based on a difference between the first heat-up characteristic and the second heat-up characteristic.

2. The image forming device according to claim 1, wherein the image forming arrangement comprises:

a feeding unit configured to feed a recording medium in the medium passage;

an image forming unit configured to form an image on the recording medium fed by the feeding unit; and a fixing unit configured to fix the image formed by the image forming unit to the recording medium, wherein the motor drives to operate at least one of the feeding unit, the image forming unit, and the fixing unit.

3. The image forming device according to claim 2, wherein the motor comprises a first motor driving to operate the feeding unit, a second motor driving to operate the image forming unit, and a third motor driving to operate the fixing unit.

4. The image forming device according to claim 1, wherein the warm-up control unit controls the motor to drive during a first period, and the image forming control unit controls the motor to drive after the first period has elapsed.

5. The image forming device according to claim 1, wherein the image forming signal includes a plurality of job signals, the image forming control unit controlling the motor to drive at either the third speed or the fourth speed based on a temperature detected by the temperature detecting unit for each job signal.

6. The image forming device according to claim 1, wherein the recording medium is in a form of cut sheets of a sheet stack, wherein the image forming control unit controls the motor to drive at either the third speed or the fourth speed based on a temperature detected by the temperature detecting unit every time an image is formed on each sheet.

7. The image forming device according to claim 1, further comprising a prohibiting unit configured to prohibit the motor from driving if a temperature detected by the temperature detecting unit is lower than a third temperature lower than the first temperature.

8. An image forming device comprising:

a casing;

an image forming arrangement provided in the casing and including a medium passage and a motor configured to drive in response to an image-forming signal or a warm-up signal;

a supplying control unit configured to allow a recording medium to be supplied in the medium passage in response to the image-forming signal, and prevent a recording medium from being supplied in the medium passage in response to the warm-up signal;

a temperature detecting unit configured to detect a temperature inside or around the casing;

a warm-up control unit configured to control the motor to drive at a first speed in response to the warm-up signal if a temperature detected by the temperature detecting unit is equal to or higher than a first temperature, and to drive at a second speed lower than the first speed until a temperature detected by the temperature detecting unit has reached a second temperature equal to or higher than the first temperature in response to the warm-up signal if a temperature detected by the temperature detecting unit is lower than the first temperature, and wherein a temperature of the toner changes based on a first heat-up characteristic and a temperature inside or around the casing changes based on a second heat-up characteristic, the second temperature is set based on a difference between the first heat-up characteristic and the second heat-up characteristic.

9. The image forming device according to claim 8, further comprising an image forming control unit configured to control the motor to drive at a third speed higher than the second speed in response to the image-forming signal after the warm-up control unit controls the motor, the first speed being equal to or different from the third speed.

10. The image forming device according to claim 9, wherein the image forming arrangement comprises:

a feeding unit configured to feed a recording medium in the medium passage;

an image forming unit configured to form an image on the recording medium fed by the feeding unit; and a fixing unit configured to fix the image formed by the image forming unit to the recording medium, wherein the motor drives to operate at least one of the feeding unit, the image forming unit, and the fixing unit.

11. The image forming device according to claim 10, wherein the motor comprises a first motor driving to operate the feeding unit, a second motor driving to operate the image forming unit, and a third motor driving to operate the fixing unit.

12. The image forming device according to claim 8, further comprising a first prohibiting unit configured to prohibit the motor from driving after the warm-up control unit controls the motor to drive during a second period.

13. The image forming device according to claim 8, further comprising a second prohibiting unit configured to prohibit the motor from driving if a temperature detected by the temperature detecting unit is lower than a third temperature lower than the first temperature.

14. An image forming device comprising:

a casing;

an image forming arrangement provided in the casing and including a medium passage and a motor configured to drive in response to an image-forming signal or a warm-up signal;

a supplying control unit configured to allow a recording medium to be supplied in the medium passage in response to the image-forming signal, and prevent a recording medium from being supplied in the medium passage in response to the warm-up signal;

a temperature detecting unit configured to detect a temperature inside or around the casing;

a warm-up control unit configured to control the motor to drive at a first speed until a temperature detected by the temperature detecting unit has reached a second temperature in response to the warm-up signal if a temperature detected by the temperature detecting unit is lower than a first temperature lower than the second temperature; and an image forming control unit configured to control the motor to drive at a second speed higher than the first speed in response to the image-forming signal after the warm-up control unit controls the motor to drive at a first speed until a temperature detected by the temperature detecting unit has reached a second temperature, wherein a temperature of the toner changes based on a first heat-up characteristic and a temperature inside or around the casing changes based on a second heat-up characteristic, the second temperature is set based on a difference between the first heat-up characteristic and the second heat-up characteristic.

15. The image forming device according to claim 14, wherein the image forming arrangement comprises:

a feeding unit configured to feed a recording medium in the medium passage;

an image forming unit configured to form an image on the recording medium fed by the feeding unit; and a fixing unit configured to fix the image formed by the image forming unit to the recording medium, wherein the motor drives to operate at least one of the feeding unit, the image forming unit, and the fixing unit.

16. The image forming device according to claim 15, wherein the motor comprises a first motor driving to operate the feeding unit, a second motor driving to operate the image forming unit, and a third motor driving to operate the fixing unit.

17. The image forming device according to claim 14, further comprising a first prohibiting unit configured to prohibit the motor from driving after the warm-up control unit controls the motor to drive during a predetermined period.

18. The image forming device according to claim 14, further comprising a second prohibiting unit configured to prohibit the motor from driving if a temperature detected by the temperature detecting unit is lower than a third temperature lower than the first temperature.

* * * * *